US010914009B2

(12) United States Patent
Choi

(10) Patent No.: US 10,914,009 B2
(45) Date of Patent: Feb. 9, 2021

(54) METHOD FOR MANUFACTURING NON-PHOSPHATE COATED METAL MATERIAL FOR COLD HEADING-PLASTIC WORKING PROCESS

(71) Applicant: HAN YOUNG STEEL WIRE CO., LTD., Chungcheongbuk-do (KR)

(72) Inventor: Eun Seok Choi, Chungcheongbuk-do (KR)

(73) Assignee: HAN YOUNG STEEL WIRE CO., LTD., Chungju-si (KR)

( * ) Notice: Subject to any disclaimer, the term of this patent is extended or adjusted under 35 U.S.C. 154(b) by 806 days.

(21) Appl. No.: 14/811,241

(22) Filed: Jul. 28, 2015

(65) Prior Publication Data

US 2016/0236236 A1 Aug. 18, 2016

(30) Foreign Application Priority Data

Feb. 16, 2015 (KR) ..... 10-2015-0023650

(51) Int. Cl.
*C23C 24/00* (2006.01)
*C23C 22/62* (2006.01)
(Continued)

(52) U.S. Cl.
CPC ..... *C23C 22/62* (2013.01); *C10M 169/04* (2013.01); *C10M 2201/062* (2013.01);
(Continued)

(58) Field of Classification Search
CPC ..... C23C 24/00; C23C 24/08; C23C 24/085; C23C 24/10; C23C 24/103; C10M 169/04; C10M 2201/062
See application file for complete search history.

(56) References Cited

U.S. PATENT DOCUMENTS 3,313,729 A * 4/1967 Glasson ..... C10M 111/02 427/276
5,866,652 A 2/1999 Hager et al.
(Continued)

FOREIGN PATENT DOCUMENTS

JP 2000-309793 A 11/2000
JP 2002264252 A * 9/2002 ..... C10M 111/00
(Continued)

OTHER PUBLICATIONS

JP 2006-272461 A machine translation (Year: 2006).*

*Primary Examiner* — Elizabeth A Robinson
(74) *Attorney, Agent, or Firm* — Rabin & Berdo, P.C.

(57) ABSTRACT

A non-phosphate coated metal material for plastic working includes a metal material, a coating layer formed on a surface of the metal material, and a lubrication layer on the coating layer. The coating layer includes calcium tetraborate. A method for manufacturing a non-phosphate coated metal material includes a pre-treatment process to remove foreign matters or scale from a surface of a metal material, a coating treatment process to form a coating layer on the surface of the metal material by dipping the metal material, which is subject to the pre-treatment process, into a coating agent, and a lubrication treatment process to form a lubrication layer on the coating layer through the contact between the coated metal material and a lubricating agent. The coating agent includes a non-phosphate treatment solution including at least one borate selected from sodium tetraborate and a hydrate thereof, sodium nitrite, calcium hydroxide, and water.

4 Claims, 6 Drawing Sheets

(51) Int. Cl.

| | |
|---|---|
| ***C10M 169/04*** | (2006.01) |
| *C10N 30/06* | (2006.01) |
| *C10N 30/12* | (2006.01) |
| *C10N 50/00* | (2006.01) |
| *C10N 80/00* | (2006.01) |

(52) U.S. Cl.
CPC ... *C10M 2201/08* (2013.01); *C10M 2201/087* (2013.01); *C10M 2207/126* (2013.01); *C10M 2207/1253* (2013.01); *C10N 2030/06* (2013.01); *C10N 2030/12* (2013.01); *C10N 2050/023* (2020.05); *C10N 2080/00* (2013.01); *Y10T 428/273* (2015.01)

(56) References Cited

U.S. PATENT DOCUMENTS

| | | | | |
|---|---|---|---|---|
| 6,077,885 | A | 6/2000 | Hager et al. | |
| 2012/0083432 | A1* | 4/2012 | Hatasaki ..... | B21C 9/00 508/176 |

FOREIGN PATENT DOCUMENTS

| | | | |
|---|---|---|---|
| JP | 2006-272461 | A | 10/2006 |
| JP | 3970368 | B2 | 9/2007 |
| JP | 4434042 | B2 | 3/2010 |
| JP | 2011-246684 | A | 12/2011 |
| KR | 10-2000-0023075 | A | 4/2000 |
| KR | 10-2002-0072634 | A | 9/2002 |
| KR | 10-2002-0089214 | A | 11/2002 |
| KR | 10-0777495 | B1 | 11/2007 |
| KR | 10-2008-0094039 | A | 10/2008 |

* cited by examiner

Ball Housing

Socket Head Bolt

Pin Striker

Welding Bolt

Press-fit Bolt

METHOD FOR MANUFACTURING NON-PHOSPHATE COATED METAL MATERIAL FOR COLD HEADING-PLASTIC WORKING PROCESS

BACKGROUND OF THE INVENTION

1. Field of the Invention

The present invention relates to a method for manufacturing a non-phosphate coated metal material for a cold heading plastic working process, and more particularly to a method for manufacturing a non-phosphate coated metal material for a cold heading plastic working process, capable of preventing a carbide from being attached onto the surface of the metal material due to a phosphate coating layer, preventing a phosphorizing phenomenon, and producing an eco-friendly effect when forming a lubrication layer appropriate to the plastic working process while performing a quenching process and/or a tempering process using a non-phosphate coating solution having a composition including specific ingredients.

2. Description of the Related Art

In general, metal products used in most industrial fields, for example, mechanical tools including bolts or nuts and metal products including vehicle parts are manufactured through a plastic working process such as a cold heading process. For example, the bolts or the nuts are manufactured by subsequently performing a cold heading-plastic working process, a degreasing process, a heat treatment process, and a surface treatment process (coloring and plating).

In the plastic working process for a metal material, such as a cold heading process and a drawing process, a lubrication layer is required on a friction interface between a mold and the metal material (workpiece). If the lubrication layer is insufficiently formed, a desirable shape may not be formed, or seizure (sticking) may occur. In particular, the above problems may seriously occur in the cold heading-plastic working process requiring significantly high pressure.

Accordingly, in the case of most metal materials (workpieces), a pre-treatment process is performed to remove foreign matters and scale from the surface of the metal materials by performing an acid pickling process before the plastic working process such as the cold heading process is performed. Then, a coating treatment process is performed for the lubrication. In this case, when the coating treatment process is performed, a bonderizing or bonderizing lubricant coating treatment scheme has been extensively used as a coating scheme of combining a chemical conversion coating layer formed by coating a phosphate crystal, such as a zinc phosphate crystal, on the surface of the metal material, and a soap-based lubricating agent. In detail, a phosphate coating agent including phosphate and zinc salt is reacted with the surface of the metal material to form a phosphate coating layer. Thereafter, the soap-based lubricating agent is applied to the phosphate coating layer to form a lubrication layer on the phosphate coating layer.

The phosphate coating layer reduces the friction, and repairs the surface of the metal material, thereby preventing the seizure in the plastic working process such as the cold heading process. In addition, the soap-based lubrication layer formed on the phosphate coating layer more increases the lubrication by reducing the friction. Therefore, as the phosphate coating treatment and the soap-based lubrication treatment are combined with each other, stable and superior lubrication is provided for the plastic working process such as the cold heading process.

For example, Korea Unexamined Patent Publication Nos. 10-2000-0023075, 10-2002-0072634, 10-2002-0089214, and 10-2008-0094039 disclose the related arts relating to a coating treatment method using a phosphate coating agent.

However, the coating treatment methods according to the related arts included in the cited references have the following problems.

As described above, the heat treatment process is performed with respect to a metal material (workpiece) after the plastic working process, such as the cold heading process, has been performed. In the heat treatment process, the carbide may be attached to the metal material and the phosphorizing may occur. In addition, phosphorus (P) contained in the phosphate coating layer may be phosphorized into the metal material in the heat treatment process. If the phosphorizing phenomenon occurs, embrittlement may occur in the metal material, so that a high-strength metal product may be sheared and the strength of the high-strength metal product may be weakened. Accordingly, a de-phosphating process must be performed before the heat treatment process is performed. In this case, when the de-phosphating treatment is performed with respect to the product, the damage may be caused to the product, so that the failure rate and the disposal cost of the product may be excessively caused, so the productivity may be degraded.

In addition, the coating treatment method according to the related art has a problem that long treatment time is required. For example, in order to obtain a superior coating layer, there is required a long time including about 20 min. to 30 min. for the pre-heating, and about 10 min. or more for the reaction time. In addition, since phosphorous (P) is an environmentally hazardous substance, the phosphate coating treatment or the phosphorizing process is not eco-friendly.

As prior arts, there are disclosed Korea Unexamined Patent Publication Nos. 10-2000-0023075, 10-2002-0072634, 10-2002-0089214, and 10-2008-0094039

SUMMARY OF THE INVENTION

The present invention is made to solve the problems occurring in the related art, and an object of the present invention is to provide a method for manufacturing a non-phosphate coated metal material for a cold heading plastic working process, capable of preventing a phosphorizing phenomenon, improving productivity, and producing an eco-friendly effect while forming a lubrication layer appropriate to a plastic working process, such as a cold heading process, by using a non-phosphate coating solution which serves as a coating agent having no phosphate and has a composition including specific ingredients, and a non-phosphate coated metal material for a cold heading plastic working process, which is manufactured by the method.

In order to accomplish the object of the present invention, there is provided a non-phosphate coated metal material for a plastic working process. The metal material includes a metal material, a coating layer formed on a surface of the metal material, and a lubrication layer on the coating layer. The coating layer includes calcium tetraborate.

In addition, there is provided a method for manufacturing a non-phosphate coated metal material for a cold heading plastic working process. The method includes performing a pre-treatment process to remove foreign matters or scale from a surface of a metal material, performing a coating treatment process to form a coating layer on the surface of the metal material by dipping the metal material, which is subject to the pre-treatment process, into a coating agent, and performing a lubrication treatment process to form a lubrication layer on the coating layer by bringing the coated metal material into contact with a lubricating agent. The coating agent is a non-phosphate coating agent which includes a non-phosphate treatment solution including at least one borate selected from sodium tetraborate and a hydrate thereof, sodium nitrite, calcium hydroxide, and water.

In this case, preferably, according to an exemplary embodiment, the non-phosphate treatment solution includes 3.5 g to 4.5 g of at least one borate selected from sodium tetraborate and a hydrate thereof, 0.2 g to 0.45 g of sodium nitrite, and 80 g to 90 g of calcium hydroxide based on 1 L of water.

In addition, preferably, the lubricating agent includes 50% by weight to 55% by weight of sodium stearate, 0.25% by weight to 2.5% by weight of the at least one borate selected from the sodium tetraborate and the hydrate thereof, 15% by weight to 20% by weight of the calcium hydroxide, and 25% by weight to 30% by weight of the stearic acid.

In addition, preferably, the coating treatment process is performed by forming the coating layer as the metal material is dipped into the non-phosphate treatment solution for a time of 4 min. to 5 min.

As described above, the lubrication layer appropriate to the plastic working process can be formed and the phosphorizing can be prevented in the heat treatment process. In addition, the coating treatment time can be reduced, so that the productivity can be improved, and the eco-friendly effect can be produced.

BRIEF DESCRIPTION OF THE DRAWINGS

FIGS. 4*a* to 4*d* are photographs showing a metal sample according to the embodiment of the present invention, in which FIG. 4*a* is a photograph showing a metal material (wire rod) before a coating treatment process is performed, FIG. 4*b* is a photograph showing the metal material after a non-phosphate coating treatment process has been performed, FIG. 4*c* is a photograph showing the metal material after a drawing process has been performed, and FIG. 4*d* illustrates photographs showing various shapes of products after a plastic working process has been performed.

DETAILED DESCRIPTION OF THE INVENTION

Figure 1:
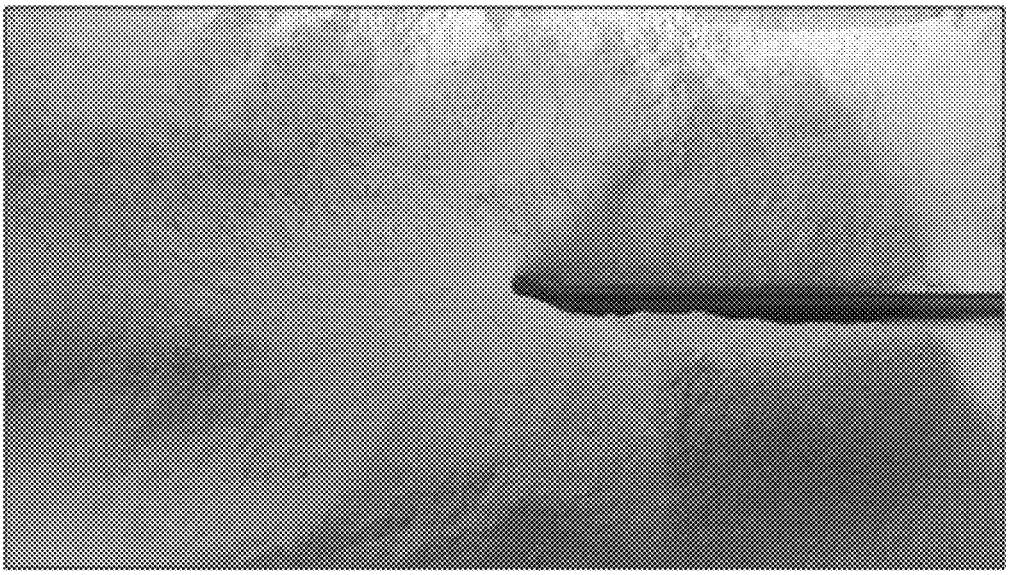
FIG. 1 is a photograph showing that lubrication treatment is performed according to an embodiment of the present invention.

Hereinafter, the present invention will be described in detail.

The term "and/or" used in the present invention represents that at least one of components arranged after and before the term "and/or" is provided.

The present invention provides a non-phosphate coated metal material for a plastic working process having a lubricated layer. In addition, the present invention provides a method for manufacturing a non-phosphate coated metal material including forming a non-phosphate coating layer, which is a lubricated layer having at least improved lubrication without phosphorus (P), on the surface of the metal material for the plastic working process.

In detail, the non-phosphate coated metal material for the plastic working process according to the present invention includes a metal material, a coating layer formed on a surface of the metal material, and a lubrication layer formed on the coating layer. In this case, the coating layer is a non-phosphate coating layer that does not contain P. The non-phosphate coating layer includes calcium tetraborate ($CaB_4O_7$).

In addition, the method for manufacturing the non-phosphate coated metal material for the plastic working process (simply non-phosphate coating treatment) according to the present invention includes at least following processes (1) to (3). The following processes (1) to (3) are subsequently performed.

(1) A pre-treatment process to remove foreign matters or scale from a surface of a metal material, (2) A coating treatment process to form a coating layer on the surface of the metal material by dipping the metal material, which is subject to the pre-treatment process, into a coating agent, (3) A lubrication treatment process to form a lubrication layer on the coating layer by bringing the coated metal material into contact with the lubricating agent.

In this case, according to the present invention, the coating agent used in the process (2) is a non-phosphate coating agent that does not contain phosphate (or phosphorous). The non-phosphate coating agent is specified to a non-phosphate treatment solution including borate, sodium nitrite, calcium hydroxide, and water. Hereinafter, the non-phosphate coated metal material for the plastic working process according to the present invention will be described while describing an exemplary embodiment in each process. In the following description of the exemplary embodiment of the present invention, the details of the general function or constitution of relevant components, which are well known to those skilled in the art, will be omitted.

(1) Pre-Treatment Process

According to the present invention, various metal materials (workpieces) for a plastic working process, such as a cold heading process, may be subject to the pre-treatment process. According to the present invention, the metal material includes semi-finished products and/or finished products, such as mechanical tools including a bolt or a nut, and metallic products including vehicle parts, and various shapes or various materials can be employed. For example, the metal material may include high-strength metal such as carbon steel, boron steel, alloy steel and/or bearing steel. For example, according to the present invention, the plastic working process may include at least one selected from cold heading and/or drawing.

The pre-treatment is performed with respect to the metal material as described above to remove foreign matters and/or scale from the surface of the metal material. Most metal materials have foreign matters, such as oil (grease) or dust, and/or scale. The foreign material or scale may exert a bad influence on the coating treatment process. Accordingly, before the coating treatment process is performed, the foreign matter and/or the scale is removed.

According to the present invention, various pre-treatment processes (processes of removing the foreign matter and/or the scale) can be employed if the pre-treatment processes remove the foreign matters or the scale from the surface of the metal material. For example, the pre-treatment processes (the processes of removing the foreign matter and/or the scale) may include an acid pickling process, a shower process and/or a rinsing process. The pre-treatment process (the process of removing the foreign matter and/or the scale) may include an alkali cleaning process in some cases. According to one example, the pre-treatment process (the process of removing the foreign matter and/or the scale) may subsequently include an acid pickling process and a rinsing (shower) process. In this case, the acid pickling process may be performed by impregnating the metal material into an acid solution including hydrochloric acid or sulfuric acid or by spraying the acid solution to the metal material. In addition, the acid solution is preferably removed through the shower process or the rinsing process.

(2) Coating Treatment Process

A chemical conversion coating layer is formed by dipping the metal material subject to the pre-treatment process (metal material from which the foreign matters and/or scale) into a coating agent. In other words, the coating layer having lubrication is formed on the surface of the metal material.

In this case, according to the present invention, the coating agent includes a non-phosphate coating agent which does not contain phosphate (phosphoric acid). In detail, the coating agent is a non-phosphate coating solution (aqueous solution) which includes borate, sodium nitrite ($NaNO_2$), calcium hydroxide ($Ca(OH)_2$), and $H_2O$, and does not include phosphate (phosphoric acid). In addition, the borate includes at least one selected from sodium tetraborate (=boron acid tetrasodium, $Na_2B_4O_7$) and the hydrate ($Na_2B_4O_7.10H_2O$) thereof. In this case, the borate (sodium tetraborate) and the calcium hydroxide form a base crystal of the coating layer. For example, the sodium nitrite serves as an oxidizer and/or a coating supplement. For example, the calcium hydroxide is used to improve the physical surface properties, such as abrasion resistance and/or corrosion resistance, and used to form a micro-crystalline coating layer.

If the metal material is dipped into the non-phosphate coating solution as described above, the coating layer having the lubrication is formed. According to the present invention, if predetermined time elapses after the metal material has been dipped into the non-phosphate coating solution as described above, the lubrication coating layer appropriate to the plastic working process, such as the cold heading process, is formed. In this case, the coating layer has a crystal including at least calcium tetraborate ($CaB_4O_7$). In addition, the coating layer may be formed in an amount of 2 $g/m^2$ to 8 $g/m^2$ on the surface of the metal material. If the coating layer is formed in an amount of less than 2 $g/m^2$, excellent lubrication and physical properties cannot be obtained. In addition, if the coating layer is formed in an amount of more than 8 $g/m^2$, the desired effect may not be produced, and a bad influence may be influenced on other physical properties (for example, s embrittlement, or tensile).

According to one embodiment, preferably, the coating treatment process is performed by dipping the metal material into the non-phosphate coating solution at the temperature of 60° C. to 85° C. (dipping temperature) for 2 min. to 5 min. (dipping time). In this case, if the dipping process is performed for the excessively short time of less than 2 min, it may be difficult to obtain an excellent coating layer, and the production of a $CaB_4O_7$ crystal may be reduced. In addition, if the dipping time exceeds 5 min, the desired effect may not be produced. In addition, the excessive dipping time is not proper in terms of productivity and energy consumption. In this regard, it is preferred that the coating treatment process is performed by performing the dipping process for the dipping time of 4 min. to 5 min. In addition, it is preferred that the dipping temperature, that is, the temperature of the non-phosphate coating solution is in the range of 70° C. to 80° C. According to the best mode, the coating treatment process is preferably performed by performing the dipping process at the temperature of 70° C. to 80° C. for the dipping time of 4 min. to 5 min.

According to the present invention, the efficiency of the coating treatment process can be improved by using the coating agent having the above-described specific ingredients. In detail, as the lubrication layer appropriate to the plastic working process is excellently formed, the carbide attachment and the phosphorizing phenomenon can be prevented in a heat treatment process. In other words, according to the present invention, since the coating agent includes the non-phosphate coating solution instead of the phosphate (phosphoric acid), the phosphorizing phenomenon can be prevented in the heat treatment process. In addition, the carbide attachment can be prevented or minimized. In addition, even if the dipping process is performed for the short dipping time of 2 min. to 5 min. (or the dipping time of 4 min. to 5 min.), the excellent coating layer may be formed. In other words, the coating treatment time can be reduced. Accordingly, the productivity can be improved, and the energy consumption can be reduced, so that treatment cost can be saved. In addition, since phosphorous (P) serving as an environmentally hazardous substance is not used, an eco-friendly effect can be produced.

According to an exemplary embodiment, the non-phosphate treatment solution includes 3.5 g to 4.5 g of at least one borate selected from sodium tetraborate ($Na_2B_4O_7$) and a hydrate ($Na_2B_4O_7.10H_2O$) thereof, 0.2 g to 0.45 g of sodium nitrite ($NaNO_2$), and 80 g to 90 g of calcium hydroxide (calcium hydroxide) based on 1 L of water. If the non-phosphate treatment solution has proper compositions within the above content range, the lubrication, the abrasion resistance, and the corrosion resistance of the coating layer, and the adhesion of the coating layer to the metal material can be significantly effectively improved, and/or the time to form the coating layer can be significantly effectively reduced. In this case, if less than 3.5 g of the borate is contained in 1 L of water, the lubrication and/or the abrasion resistance may be slightly represented. In addition, if less than 0.2 g of the sodium nitrite is contained, the adhesion may be slightly represented or the time to form the coating layer may be increased. If less than 80 g of calcium hydroxide is contained, the adhesion, the abrasion resistance and/or corrosion resistance may be degraded. In addition, the use of the ingredients in content exceeding the above range may be undesirable because the desired effect may not be produced, and a portion of the ingredients may remain without participating in the formation of the coating layer.

(3) Lubrication Treatment Process

After the coating layer has been formed using the non-phosphate containing solution, a lubrication layer is formed on the coating layer by bringing the metal material, which is subject to the coating treatment process, into contact with a lubricating agent. The lubrication can be more improved through the lubrication treatment process. In this case, various lubricating agents (lubrication layers) sufficient to improve the lubrication may be employed. For example, a typical lubricating agent may be used.

According to the exemplary embodiment, the lubricating agent (lubricating agent) preferably includes powders including sodium stearate, at least one borate selected from sodium tetraborate and a hydrate thereof, calcium hydroxide, and stearic acid. The lubricating agent including the composites is appropriate to the present invention since the lubricating agent not only is effective in improving the lubrication, but also represents excellent adhesion to the coating layer formed using the non-phosphate coating solution. According to a more detailed embodiment, the lubricating agent (lubrication layer) preferably includes 50% by weight to 55% by weight of sodium stearate, 0.25% by weight to 2.5% by weight of the at least one borate selected from the sodium tetraborate and the hydrate thereof, 15% by weight to 20% by weight of the calcium hydroxide, and 25% by weight to 30% by weight of the stearic acid, based on the whole weight of the lubricating agent (lubrication layer).

The lubrication treatment may be performed by applying the lubricating agent to the metal material through a spraying scheme, or by passing the metal material through a laminate in which lubricating agents having a powder phase are laminated (see FIG. 1).

As described above, according to the present invention, the lubrication layer appropriate to the plastic working process, such as a cold heading process, is formed while the carbide attachment and the phosphorizing phenomenon can be prevented in a heat treatment process, and a dephosphorization process can be omitted. In addition, the time for the coating treatment process is reduced, so that the productivity can be improved and the eco-friendly effect can be produced.

Hereinafter, the embodiments of the present invention and comparative examples will be described for the illustrative purpose. The following embodiments are provided for the illustrative purpose of understanding the present invention, but the technical scope of the present invention is not limited thereto. In addition, the following comparative examples do not refer to the related art, but are provided for the comparison with the embodiments.

Embodiments 1 to 3

Pre-Treatment (Removal of Foreign Matter and/or Scale)

A wire rod including carbon steel was prepared as a metal sample. Then, the wire rod was dipped into a hydrochloric acid solution having the temperature of about 60° C. for 5 min to be acid-pickled. Thereafter, the metal sample subject to the acid-pickling was rinsed three time using tap water having a normal temperature (of about 12° C.) and then dried.

<Chemical Conversion Coating Treatment Process>

First, the hydrate of sodium tetraborate ($Na_2B_4O_7.10H_2O$) was put into water and dissolved. Then, sodium nitrite ($NaNO_2$) and calcium hydroxide ($Ca(OH)_2$) were sequentially dropped and dissolved. Thereafter, water was supplemented, so that the non-phosphate coating treatment solution (aqueous solution) was prepared. In this case, as shown in table 1, the compositions (contents) of the non-phosphate coating treatment solution were varied depending on the embodiments. In following table 1, the content (weight) of each ingredient was employed based on 1 L of water.

Thereafter, the metal sample was dipped into the non-phosphate coating treatment solution according to the embodiments, and the dipping state of the metal sample was maintained at the temperature of about 80° C. for 4.5 min. (270 sec.).

<Lubrication Treatment Process>

The lubricating agent was prepared in the form of solid white powders by mixing 50% by weight of sodium stearate, 2% by weight of hydrate of sodium tetraborate ($Na_2B_4O_7.10H_2O$), 20% by weight of calcium hydroxide, and 28% by weight of stearic acid together based on the whole weight.

Subsequently, after passing the coated metal sample through the lubricating agent having the powder phase (bringing the coated metal sampled into contact with the lubricating agent), the coated metal sample was dried and subject to the lubrication treatment. FIG. 1 is a photograph showing a lubrication treatment procedure.

Comparative Examples 1 to 3

Comparative examples 1 to 3 were treated in the same manner as that of embodiment 1 except for the change in the composition (ingredient and content) of the non-phosphate coating treatment solution when the chemical conversion coating treatment process is performed. In the case of comparative example 3, the lubricating agent having a different composition was used. The compositions of the non-phosphate coating treatment solution according to comparative examples are shown in table 1.

Comparative Examples 4 and 5

Comparative examples 4 and 5 were treated in the same manner as that of embodiment 1 except that different chemical conversion coating treatment solution was employed. In detail, according to the present comparative example, a typical zinc-phosphate-based coating agent (aqueous solution) according to the related art was used as a coating agent. The metal sample was dipped into the typical zinc-phosphate-based coating agent and then the dipping state of the metal sample was maintained at the temperature of about 80° C. for 20 min. (comparative example 4) and 10 min. (comparative example 5) so that the metal sample was coated. Thereafter, the metal sample was subject to the lubrication treatment process in the same manner as that of the embodiment 1.

TABLE 1

<Compositions of coating agent and lubricating agent according to the embodiments and comparative examples>

| | Coating treatment | | | | | Lubricating Agent (wt %) | | | |
|---|---|---|---|---|---|---|---|---|---|
| | Non-phosphate coating treatment solution (Based on 1 L of water) | | | | Dipping time | | | | |
| Remarks | Na—B | $NaNO_2$ | $Ca(OH)_2$ | $K_2SO_4$ | (80° C.) | St—Na | Na—B | $Ca(OH)_2$ | St |
| Embodiment 1 | 4.0 g | 0.2 g | 85 g | | 270 sec. | 50 | 2 | 20 | 28 |
| Embodiment 2 | 5.0 g | 0.1 g | 75 g | | 270 sec. | 50 | 2 | 20 | 28 |

TABLE 1-continued

<Compositions of coating agent and lubricating agent according to the embodiments and comparative examples>

| | Coating treatment | | | | | | | | |
|---|---|---|---|---|---|---|---|---|---|
| | Non-phosphate coating treatment solution (Based on 1 L of water) | | | | Dipping time | Lubricating Agent (wt %) | | | |
| Remarks | Na—B | $NaNO_2$ | $Ca(OH)_2$ | $K_2SO_4$ | (80° C.) | St—Na | Na—B | $Ca(OH)_2$ | St |
| Embodiment 3 | 3.0 g | 0.5 g | 95 g | | 270 sec. | 40 | 12 | 20 | 28 |
| Comparative Example 1 | 4.0 g | | 85 g | 0.2 g | 270 sec. | 50 | 2 | 20 | 28 |
| Comparative Example 2 | 4.0 g | | | 0.5 g | 270 sec. | 50 | 2 | 20 | 28 |
| Comparative Example 3 | 5.0 g | | 95 g | 0.5 g | 270 sec. | 50 | | 20 | 30 |
| Comparative Example 4 | | | | | 20 min. | 50 | 2 | 20 | 28 |
| Comparative Example 5 | | | | | 10 min. | 50 | 2 | 20 | 28 |

Na—B: hydrate of sodium tetraborate ($(Na_2B_4O_7 \cdot 10H_2O)$)

St—Na: sodium stearate

St: Stearic acid

Comparative examples 4 and 5: zinc-phosphate-based coating agent

A phosphorous (P) detection test was performed with respect to the embodiment 1 and the comparative example 4 as follows. In addition, the abrasion resistance, the corrosion resistance, the adhesion, and the plastic working performance (lubrication performance) were evaluated. The evaluation results are shown in table 2.

1. Phosphorous Detection Test 10 ml of a test solution (de-phosphating heating test solution was obtained by dissolving 10 g of ammonium molybdate into 50 ml of distilled water and mixing 135 ml of sulfuric acid with the solution) was put into a 300 ml triangular flask and diluted with 50 ml of distilled water. Thereafter, after cutting a sample in a length of 5 cm, the sample was put into the triangular flask and shaken for 10 sec. Then, the sample was taken out of the triangular flask. Subsequently, after applying ascorbic acid to the solution, the solution was heated to 80° C. (ascorbic acid was dissolved using a magnetic bar). In this case, if the solution is changed to a colorless solution or a dark blue solution, the solution is determined to have phosphate.

Figure 2:
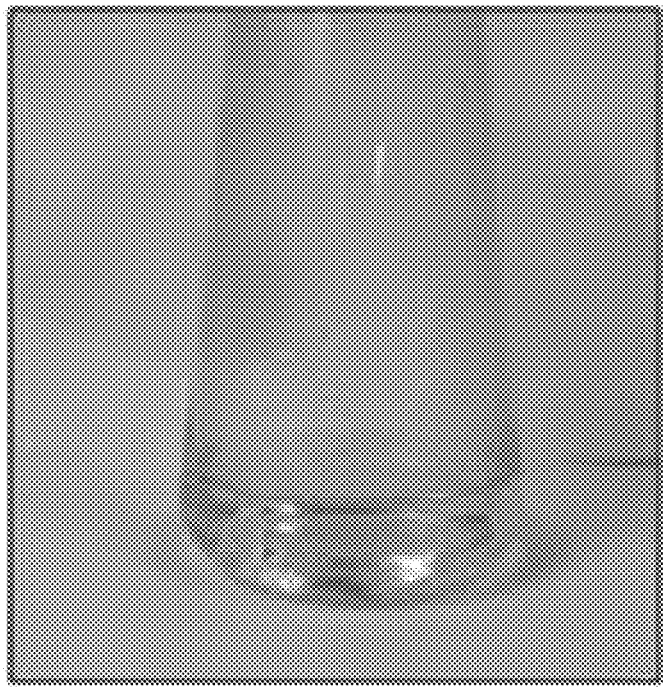
FIG. 2 is a photograph showing the result of a test of detecting phosphorous (P) from a sample according to an embodiment of the present invention.
Figure 3:
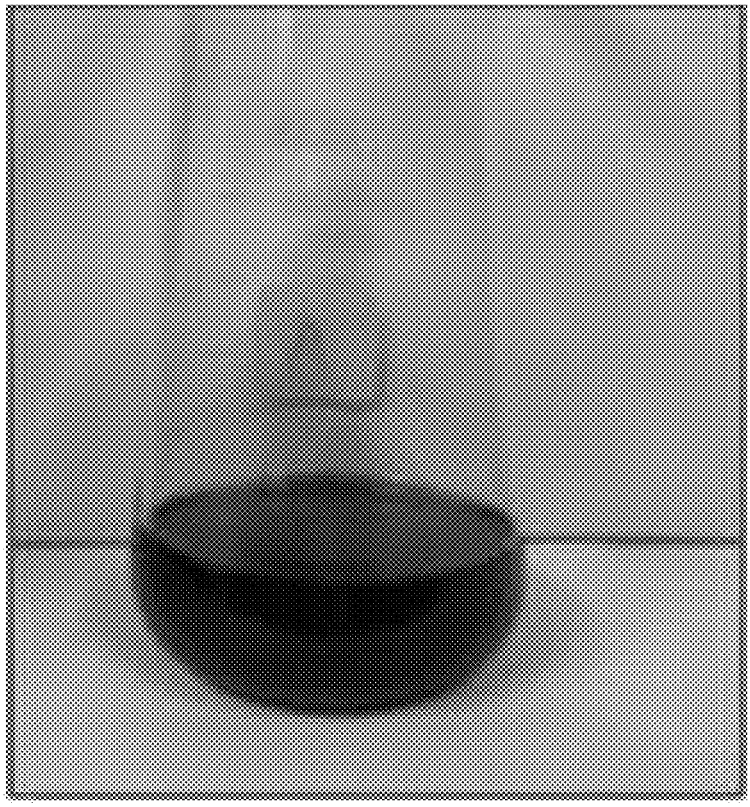
FIG. 3 is a photograph showing the result of a test of detecting phosphorous (P) from a sample according to a comparative example.

FIG. 2 is a photograph showing the result of the P detection test for the sample according to the first embodiment through the above procedure. FIG. 3 is a photograph showing the result of the P detection test for the sample according to the comparative example 4 through the above procedure. It can be recognized from FIGS. 2 and 3 that the sample according to the first embodiment (see FIG. 2) is represented in yellow color, so that P is not detected from the sample, but the sample according to the comparative example 4 (see FIG. 3) is represented in dark blue, so that P is detected from the sample.

2. Abrasion Resistance

The abrasion resistance was evaluated with respect to a chemical conversion coating layer (before lubrication treatment) of each metal sample through falling sand abrasion testing according to ASTM D 968. In this case, an abrasion degree was evaluated by observing the falling sand abrasion testing with a naked eye, and the evaluation criterion is as follows.

<Evaluation Criterion of Abrasion Resistance>

◎: Peeling or scratch is never shown in the coating layer.

○: An area ratio of the coating layer having peeling or scratch ranges from 10% to less than 20%.

Δ: An area ratio of the coating layer having peeling or scratch ranges 20% to less than 50%.

X: An area ratio of the coating layer having peeling or scratch is 50% or more.

3. Corrosion Resistance

The corrosion resistance was evaluated with respect to a chemical conversion coating layer (before lubrication treatment) of each metal sample through a salt spray test. In this case, after spraying 5% by weight of an NaCl solution (at 35° C.) on the surface of the coating layer for 24 hours, a discoloration state (rust state) of the coating layer was determined by observing the coating layer with a naked eye, and the evaluation criterion is as follows.

<Evaluation Criterion of Corrosion Resistance>

◎: No discoloration

○: A discolored area ranges from 10% to less than 20%

Δ: A discolored area ranges from 20% to less than 50%

X: A discolored area is 50% or more

4. Adhesion

The adhesion was evaluated with respect to each metal sample by observing a peeling degree (delamination) in the lubrication layer of a sample (processed product) deformed after performing the plastic working (cold heading) process in a mold. The evaluation criterion of the adhesion is as follows.

<Evaluation Criterion of Adhesion>

○: Peeling is never shown in a coating layer.

Δ: Peeling is shown in a portion of the coating layer.

X: An entire portion of the coating layer is peeled.

5. Plastic Working Performance (Lubrication Performance)

Plastic working performance was evaluated with respect to each metal sample by observing the degree of scars or seizure (sticking) on the surface of a deformed sample (processed product) or the surface of a mold after performing a plastic working (cold heading) process in the mold. The evaluation criterion of the adhesion is as follows.

<Evaluation Criterion of Plastic Working Performance>

◎: Scars or seizure (sticking) is never shown on the surface of the processed product or the surface of the mold.

○: An area occupied by the scars or seizure ranges from 10% to less than 20% of the surface of the processed product or the mold.

Δ: An area occupied by the scars or seizure ranges 20% to less than 50% of the surface of the processed product or the mold.

X: An area occupied by the scars or seizure is 50% or more of the surface of the processed product or the mold.

TABLE 2

<Evaluation results of physical properties of the metal samples according to the embodiments and the comparative examples>

| Remark | Abrasion resistance | Corrosion resistance | Adhesion | Plastic working performance |
|---|---|---|---|---|
| Embodiment 1 | ◎ | ◎ | ○ | ◎ |
| Embodiment 2 | ○ | ○ | Δ | ◎ |
| Embodiment 3 | ○ | Δ | Δ | ○ |
| Comparative Example 1 | ○ | Δ | X | Δ |
| Comparative Example 2 | X | Δ | X | Δ |
| Comparative Example 3 | ○ | ○ | X | X |
| Comparative Example 4 | ○ | ○ | ○ | ◎ |
| Comparative Example 5 | Δ | Δ | X | Δ |

As shown in table 2, the metal samples according to the embodiments show results superior to those of the comparative examples. When comparing the embodiments 1 to 3 with the comparative examples 1 to 3, the difference between physical properties is made according to the compositions (ingredients and contents) of the coating agent (non-phosphate coating treatment solution). Especially, the embodiment 1 shows a significantly superior result.

In addition, when comparing the embodiments with the comparative examples 4 and 5, although the zinc-phosphate based coating agent according to the related art show a superior result when the coating treatment process is performed for a long time (20 min. in the case of the comparative example 4), the embodiments show superior results even though the coating treatment process is performed for a short time (270 sec.=4.5 min.).

Figure 4A:
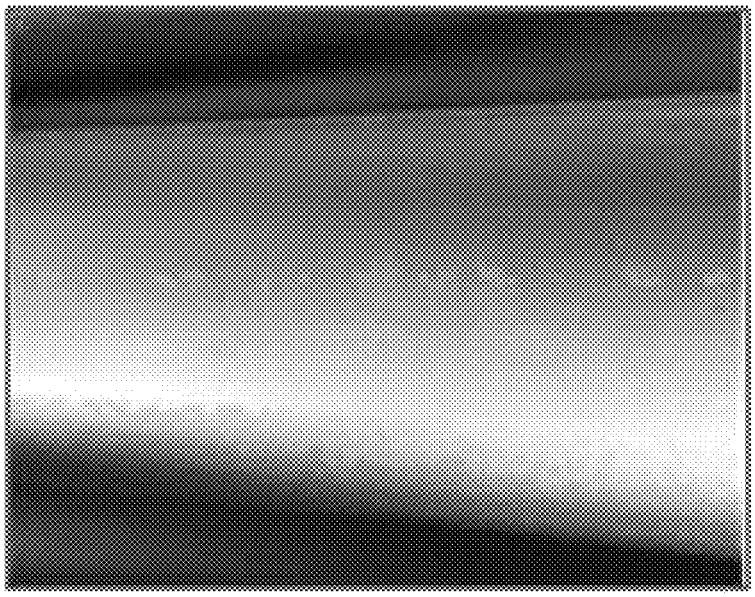
Figure 4B:
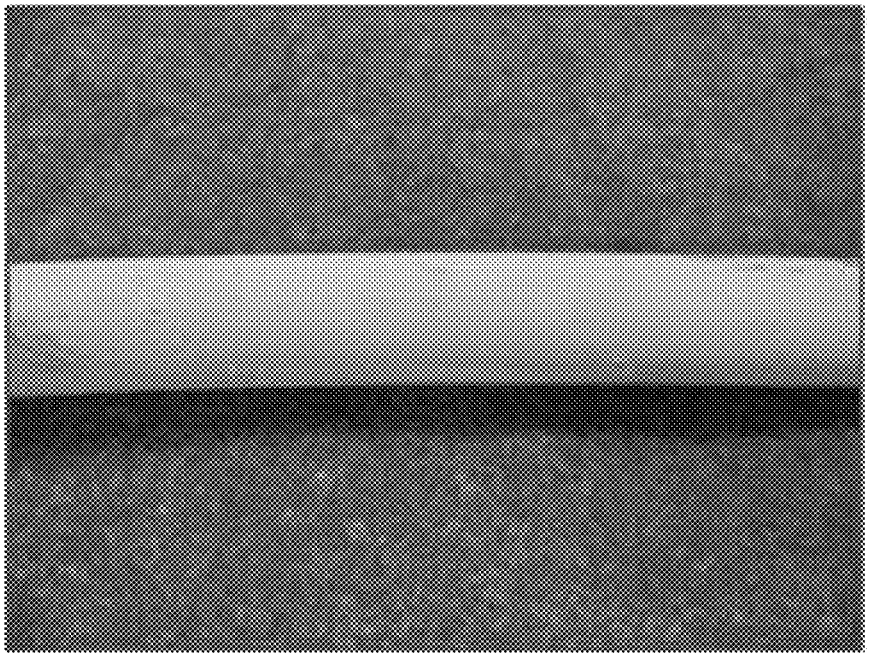
Figure 4C:
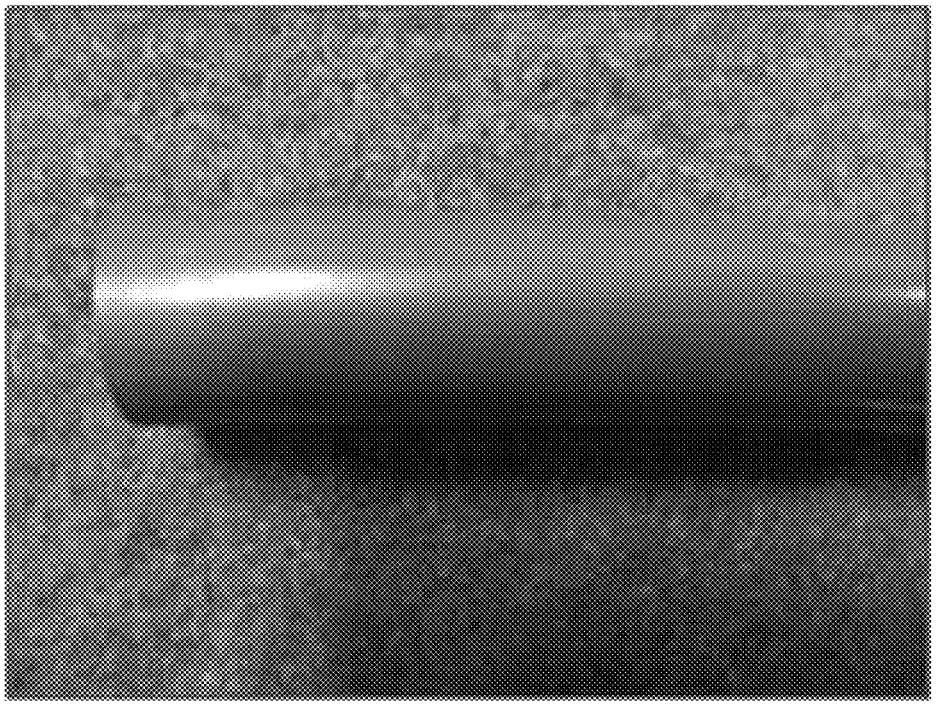
Figure 4D:
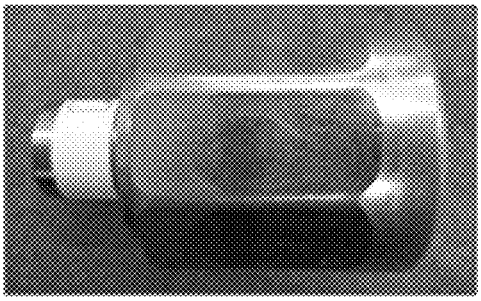
Figure 4D:
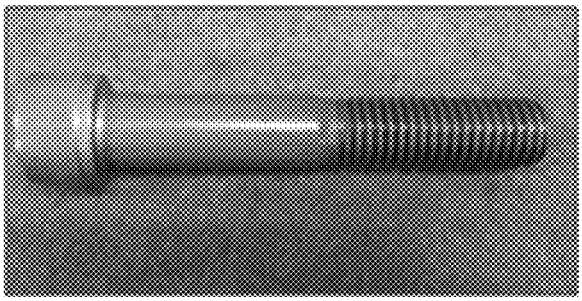
Figure 4D:
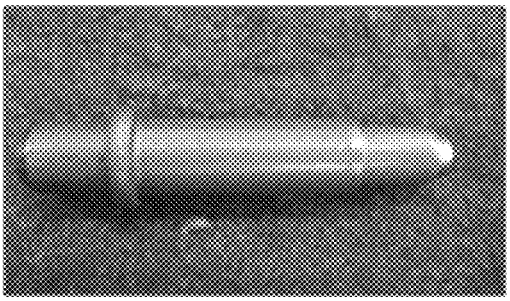
Figure 4D:
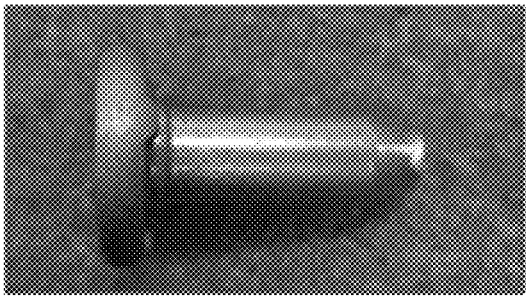
Figure 4D:
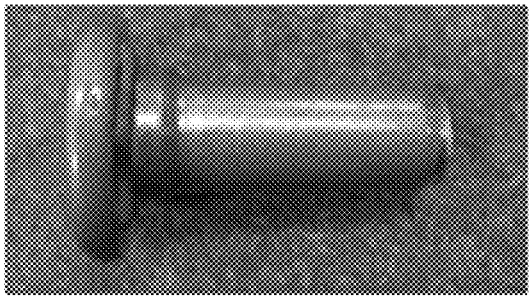

FIG. 4*a* is a photograph showing a source material before the coating treatment is performed with respect to the metal sample, FIG. 4*b* is a photograph showing the metal material after lubrication and coating treatment (coating treatment and lubrication treatment) has been performed with respect to the metal sample, FIG. 4*c* is a photograph showing the metal sample after a drawing process has been performed with respect to the metal sample according to the first embodiment, and FIG. 4*d* illustrates photographs showing various shapes of products after a plastic working process has been performed.

Embodiments 4 to 17

According to embodiments 4 to 17, evaluation was performed in the same manner as that of the embodiment 1 except that a different non-phosphate coating treatment solution and a different dipping condition were employed when chemical conversion coating treatment was performed. In detail, when the coating treatment was performed, a non-phosphate treatment solution, including 4.0 g of sodium tetraborate ($Na_2B_4O_7.10H_2O$), 0.3 g of sodium nitrite ($NaNO_2$), and 85 g of calcium hydroxide $Ca(OH)_2$ based on 1 L of water, was used, and the dipping time and the dipping temperature were varied depending on the embodiments in order to observe the characteristics according to dipping conditions. The dipping times and the dipping temperatures according to the embodiments are shown in table 3.

In addition, the abrasion resistance, the corrosion resistance, the adhesion, and the plastic working performance (lubrication performance) were evaluated with respect to the metal samples according to the embodiments. In addition, the productivity was evaluated with respect to the metal sample according to each embodiment. The evaluation results are shown in table 3 and FIG. 5. In this case, the evaluation criterion of the productivity is as follows.

<Evaluation Criterion of Productivity>

◎: The dipping time is 4.5 min. or less.

Δ: The dipping time is in the range of 4.5 to 5.5.

X: The dipping time exceeds 5.5 min.

TABLE 3

<Evaluation Results of Physical Properties And Productivity For Metal Sample According To Embodiments>

| Remark | Dipping time (min.) | Dipping temp. (° C.) | Abrasion resistance | Corrosion resistance | Adhesion | Plastic working performance | Productivity |
|---|---|---|---|---|---|---|---|
| Embodiment 4 | 3.0 | 60 | Δ | Δ | Δ | X | ◎ |
| Embodiment 5 | 3.5 | 65 | ○ | Δ | Δ | X | ◎ |
| Embodiment 6 | 4.0 | 70 | ○ | ○ | ○ | Δ | ◎ |
| Embodiment 7 | 4.5 | 75 | ◎ | ◎ | ○ | ◎ | ◎ |
| Embodiment 8 | 5.0 | 80 | ◎ | ◎ | ○ | ◎ | Δ |
| Embodiment 9 | 5.5 | 85 | ◎ | ◎ | ○ | Δ | Δ |
| Embodiment 10 | 6.0 | 90 | ○ | ○ | ○ | Δ | X |
| Embodiment 11 | 6.5 | 95 | ○ | ○ | ○ | Δ | X |
| Embodiment 12 | 6.0 | 60 | ○ | Δ | Δ | Δ | X |
| Embodiment 13 | 5.5 | 65 | ○ | ○ | Δ | Δ | Δ |
| Embodiment 14 | 5.0 | 70 | ◎ | ○ | ○ | Δ | Δ |
| Embodiment 15 | 4.0 | 80 | ○ | ○ | ○ | Δ | ◎ |
| Embodiment 16 | 3.5 | 85 | Δ | Δ | Δ | X | ◎ |
| Embodiment 17 | 3.0 | 90 | Δ | X | X | X | ◎ |

Figure 5:
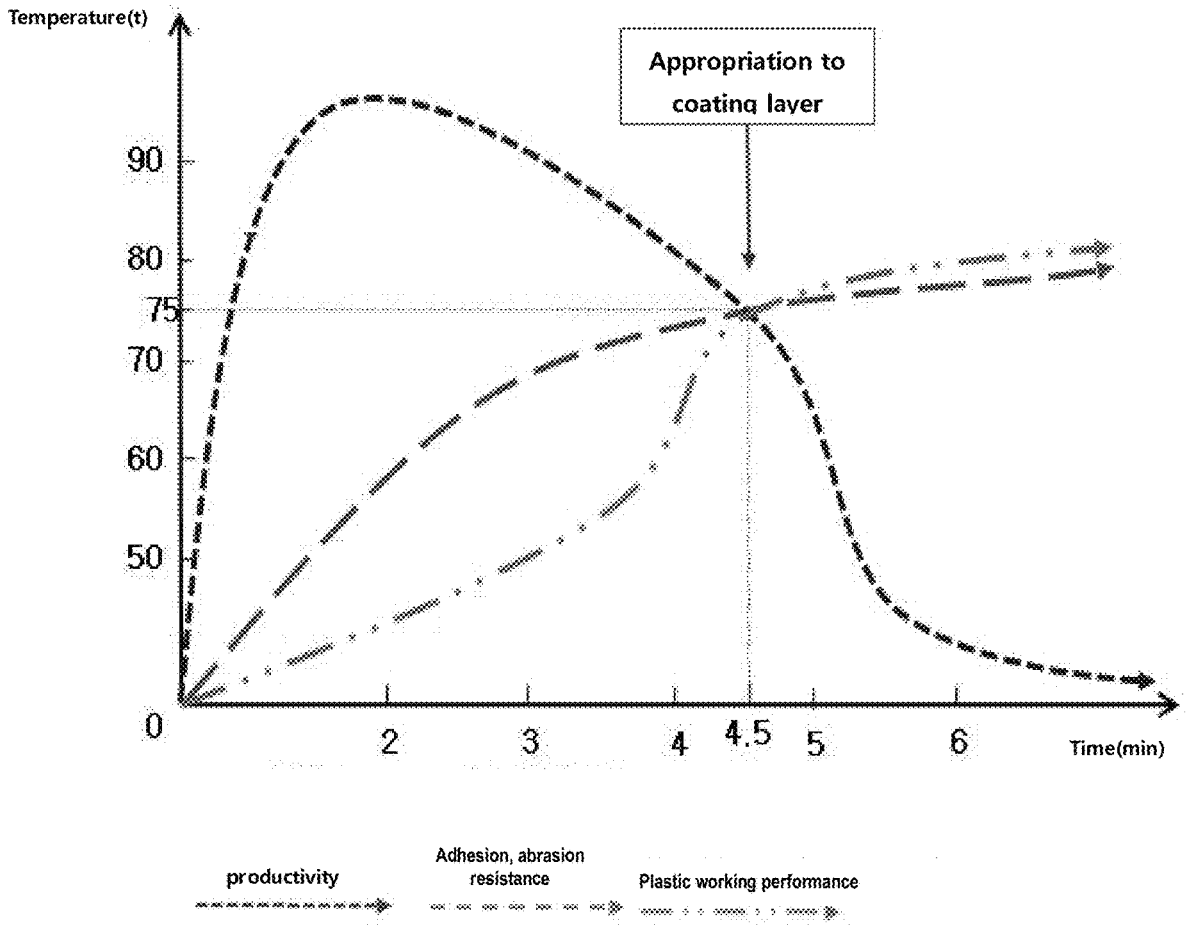
FIG. 5 is a graph showing an evaluation result of a physical property and productivity of a metal sample according to the embodiment of the present invention.

As shown in table 3 and FIG. 5, the physical properties (abrasion resistance, corrosion resistance, adhesion, and plastic working performance) and the productivity are varied depending on the dipping times and the dipping temperatures.

It can be recognized from the evaluation results that significantly superior results are shown in the productivity as well as the physical properties, such as the abrasion resistance, the corrosion resistance, the adhesion, and the plastic working performance when the coating treatment process is performed at the dipping temperature of 70° C. to 80° C. for the dipping time of 4 min. to 5 min. Especially, the optimal evaluation result can be obtained when the coating treatment process is performed at the dipping temperature of 75° C. for the dipping time of 4.5 min.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A non-phosphate coated metal material for a plastic working process, consisting essentially of:

a metal material;

a coating layer formed on a surface of the metal material; and a lubrication layer that is laminated formed on the coating layer, wherein the coating layer is coated in an amount of 2 g/m$^2$ to 8 g/m$^2$ on the surface of the metal material, and wherein the coating layer is formed by dipping the metal material into a coating agent that consists essentially of 3.5 g to 4.5 g of at least one borate selected from sodium tetraborate and a hydrate thereof; 0.2 g to 0.45 g of sodium nitrite; and 80 g to 90 g of calcium hydroxide based on 1 liter of water to form a coated metal material, and wherein the coating layer includes crystalline calcium tetraborate formed after the metal material is dipped into the coating agent, and wherein the lubrication layer is formed as a separate layer on the coating layer by bringing the coated metal material into contact with a lubricating agent that consists essentially of sodium stearate; at least one borate selected from sodium tetraborate and a hydrate thereof; calcium hydroxide; and stearic acid.

2. The non-phosphate coated metal material of claim 1, wherein the lubrication layer provides sodium stearate at 50% by weight to 55% by weight, the at least one borate at 0.25% by weight to 2.5% by weight, calcium hydroxide at 15% by weight to 20% by weight, and stearic acid at 25% by weight to 30% by weight.

3. The non-phosphate coated metal material of claim 1 wherein the coating layer is formed by dipping the metal material into the coating agent for 2 to 5 minutes at 60° C. to 85° C.

4. The non-phosphate coated metal material of claim 3 wherein the coating layer is formed by dipping the metal material into the coating agent for 4 to 5 minutes at 70° C. to 80° C.

* * * * *